US010379480B2

(12) United States Patent
Takuwa

(10) Patent No.: US 10,379,480 B2
(45) Date of Patent: Aug. 13, 2019

(54) IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Noriyuki Takuwa, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/058,155

(22) Filed: Aug. 8, 2018

(65) Prior Publication Data

US 2018/0348693 A1 Dec. 6, 2018

Related U.S. Application Data

(63) Continuation of application No. 15/681,743, filed on Aug. 21, 2017, now Pat. No. 10,073,402.

(30) Foreign Application Priority Data

Sep. 1, 2016 (JP) ..... 2016-170733

(51) Int. Cl.
*B65H 29/58* (2006.01)
*B65H 7/00* (2006.01)
(Continued)

(52) U.S. Cl.
CPC ..... *G03G 15/6552* (2013.01); *B65H 7/00* (2013.01); *B65H 29/125* (2013.01); *B65H 29/14* (2013.01);
(Continued)

(58) Field of Classification Search
CPC ..... G03G 15/6552; G03G 2215/00945; G03G 2215/2045; G03G 2215/00949; B65H 7/00; B65H 29/125; B65H 29/14; B65H 31/02; B65H 31/24; B65H 43/00; B65H 43/06; B65H 29/58; B65H 2513/104; B65H 2513/10; B65H 2513/108; B65H 2301/4212; B65H 2405/11151;
(Continued)

(56) References Cited

U.S. PATENT DOCUMENTS 5,181,705 A * 1/1993 Ueda ..... B41J 11/42 271/176
7,413,178 B2 * 8/2008 Fujii ..... B65H 29/51 270/58.01
(Continued)

FOREIGN PATENT DOCUMENTS

JP H09-86755 A 3/1997

*Primary Examiner* — Anh T Vo
(74) *Attorney, Agent, or Firm* — Kim & Stewart LLP

(57) ABSTRACT

In one embodiment, an image forming apparatus has an image forming device, a discharge port of a recording medium, a conveying device of the recording medium, and a controller. The controller judges a kind of the recording medium and the discharge port that is a conveying destination of the recording medium. The controller controls a conveying speed of the recording medium to be discharged from the discharge port by the conveying device, in accordance with the kind of the recording medium and the conveying destination of the recording medium which have been judged.

15 Claims, 6 Drawing Sheets

(51) Int. Cl.

| | |
|---|---|
| ***G03G 15/00*** | (2006.01) |
| ***B65H 29/12*** | (2006.01) |
| ***B65H 29/14*** | (2006.01) |
| ***B65H 31/02*** | (2006.01) |
| ***B65H 31/24*** | (2006.01) |
| ***B65H 43/00*** | (2006.01) |
| ***B65H 43/06*** | (2006.01) |
| *B41J 13/10* | (2006.01) |

(52) U.S. Cl.
CPC ..... *B65H 29/58* (2013.01); *B65H 31/02* (2013.01); *B65H 31/24* (2013.01); *B65H 43/00* (2013.01); *B65H 43/06* (2013.01); *B41J 13/106* (2013.01); *B65H 2301/4212* (2013.01); *B65H 2405/11151* (2013.01); *B65H 2408/10* (2013.01); *B65H 2511/13* (2013.01); *B65H 2511/416* (2013.01); *B65H 2513/10* (2013.01); *B65H 2513/104* (2013.01); *B65H 2513/108* (2013.01); *B65H 2513/42* (2013.01); *B65H 2553/612* (2013.01); *B65H 2701/1311* (2013.01); *B65H 2701/1313* (2013.01); *B65H 2801/06* (2013.01); *B65H 2801/27* (2013.01); *G03G 2215/00945* (2013.01); *G03G 2215/00949* (2013.01); *G03G 2215/2045* (2013.01)

(58) Field of Classification Search
CPC ..... B65H 2511/13; B65H 2511/416; B65H 2513/42; B65H 2553/612; B65H 2701/1311; B65H 2701/1313; B65H 2801/27; B65H 2801/06; B65H 2408/10; B65H 2220/01; B65H 2220/02; B41J 13/106
See application file for complete search history.

(56) References Cited

U.S. PATENT DOCUMENTS

| | | | | |
|---|---|---|---|---|
| 7,577,396 | B2 | 8/2009 | Kitano | |
| 8,474,815 | B2 | 7/2013 | Takahashi | |
| 8,678,374 | B2 | 3/2014 | Ikeuchi et al. | |
| 8,736,926 | B2 * | 5/2014 | Suzuki ..... | G03G 15/607 271/265.01 |
| 8,794,615 | B2 | 8/2014 | Kato et al. | |
| 9,637,337 | B2 | 5/2017 | Takuwa | |
| 2012/0204693 | A1 | 8/2012 | Yoshida | |
| 2016/0318728 | A1 | 11/2016 | Kowase | |

* cited by examiner

IMAGE FORMING APPARATUS

CROSS-REFERENCE TO RELATED APPLICATION

This application is a continuation of U.S. patent application Ser. No. 15/681,743, filed on Aug. 21, 2017, which application is based upon and claims the benefit of priority from the prior Japanese Patent Application No. 2016-170733, filed on Sep. 1, 2016, the entire contents of which are incorporated herein by reference.

FIELD

Embodiments described herein relate generally to a sheet forming apparatus.

BACKGROUND

An image forming apparatus executes printing in accordance with a print request. The image forming apparatus conveys a sheet such as a paper sheet, forms an image on the sheet, and discharges the sheet formed with the image. By this means, the image forming apparatus stacks the sheet formed with the image on a sheet discharge tray provided at a discharge port.

In the image forming apparatus as described above, if a speed for discharging the sheet to the sheet discharge tray is erroneous, the consistency in sheet discharging may be deteriorated, such that the sheet is dropped without being loaded on the sheet discharge tray, or the sheet has not been completely discharged from the discharge port.

DETAILED DESCRIPTION

According to one embodiment, an image forming apparatus has an image forming device, a discharge port of a recording medium, a conveying device, and a controller. The image forming device forms an image on the recording medium. The discharge port is provided at a downstream side of the image forming. The conveying device conveys the recording medium to the discharge port via the image forming device. The controller acquires information indicating a kind of the recording medium, and when having judged that the kind of the recording medium is a first kind based on the acquired information, the controller controls the conveying device so that after the recording medium has been conveyed at a first speed at the downstream side from the image forming device, the recording medium is decelerated to a second speed that is slower than the first speed and is discharged from the discharge port. When having judged that the kind of the recording medium is a second kind, the controller controls the conveying device so that after the recording medium has been conveyed at a third speed that is slower than the first speed at the downstream side from the image forming device, the recording medium is discharged from the discharge port at the third speed.

Figure 1:
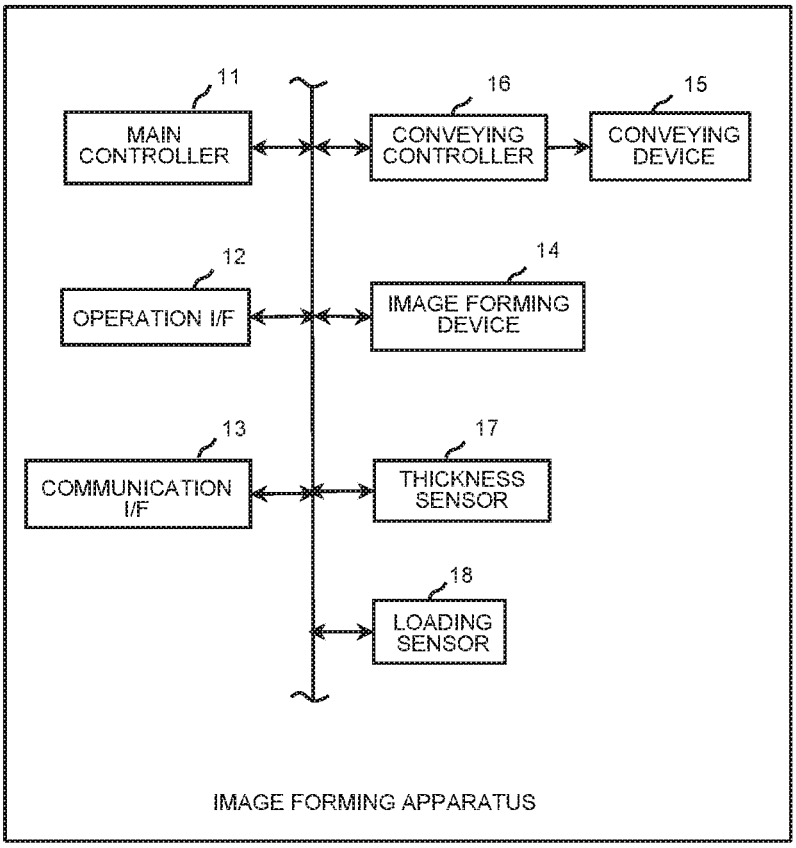
FIG. 1 is a block diagram showing an image forming apparatus according to an embodiment.
Figure 2:
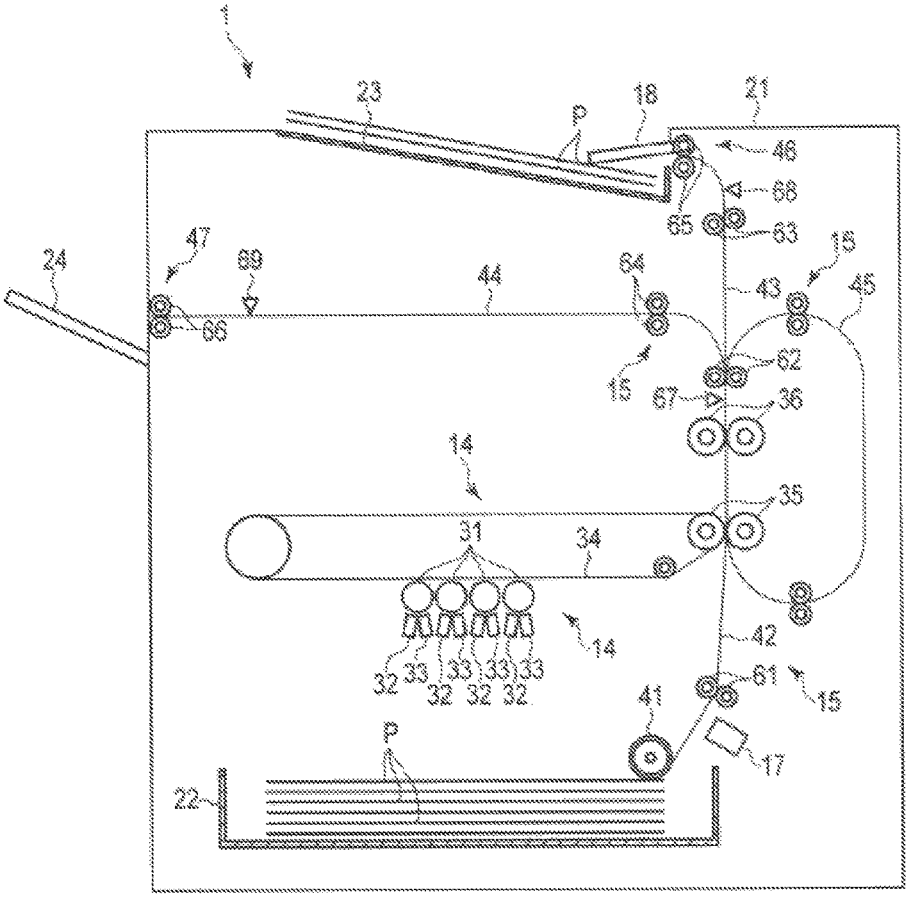
FIG. 2 is a sectional view showing the image forming apparatus according to the embodiment.

Hereinafter, image forming apparatuses according to embodiments will be described with reference to the drawings. In the drawings, the same symbols indicate the same or similar portions. To begin with, an image forming apparatus 1 according to a first embodiment will be described. FIG. 1 and FIG. 2 are each an explanation diagram showing a configuration example of the image forming apparatus 1 according to the first embodiment. FIG. 1 is a block diagram showing the image forming apparatus 1. FIG. 2 is a sectional view showing a configuration example of the conveying device and the image forming device of the image forming apparatus 1 according to the first embodiment.

The image forming apparatus 1 is an apparatus which forms an image on a sheet such as a paper sheet with toner. The image forming apparatus 1 performs various processings such as image forming while conveying a recording medium such as a sheet P, for example. The image forming apparatus 1 is an apparatus such as a laser printer, an ink jet printer, for example. In addition, the image forming apparatus 1 described later is a laser printer. In addition, the sheet P on which an image is to be formed by the image forming apparatus 1 will be described as one having flexibility. The flexibility indicates property of deformation of a matter. For example, the embodiment will be described such that when having a high flexibility, a matter is easily deformed, and when having a low flexibility, a matter is hardly deformed. In addition, the flexibility of the sheet P is generally determined by a material for forming the sheet P and a thickness thereof. The flexibility of the sheet P may be expressed by a ream weight, a basis weight, or the like of the sheet P.

As shown in FIG. 1, the image forming apparatus 1 has a main controller 1, an operation I/F (INTERFACE) 12, a communication I/F 13, an image forming device 14, a conveying device 15, a conveying controller 16, a thickness sensor 17, and a loading sensor 18. In addition, as shown in FIG. 2, the image forming apparatus 1 has a sheet feeding cassette 22, a first sheet discharge tray 23, and a second sheet discharge tray 24. A chassis 21 of the image forming apparatus 1 houses the above-described respective devices 11-18 and 22-24 inside thereof.

The sheet feeding cassette 22 is a cassette which houses sheets P. The sheet feeding cassette 22 is configured so that the sheets P can be fed from the outside of the chassis 21. For example, the sheet feeding cassette 22 is provided drawably from the chassis 21.

The first sheet discharge tray 23 is a tray which supports the sheet P discharged from the image forming apparatus 1. For example, the first sheet discharge tray 23 is provided on an upper surface of the chassis 21.

The second sheet discharge tray 24 is a tray which supports the sheet P discharged from the image forming apparatus 1. For example, the second sheet discharge tray 24 is provided at a side surface of the chassis 21 when the surface thereof on which the first discharge tray 23 is provided is decided as an upper surface.

The main controller 11 controls the whole of the image forming apparatus 1. The main controller 1 has a processor such as a CPU, and a memory. The processor of the main controller 11 executes a program stored in the memory, to realize various processing functions. The main controller 11 controls the conveying controller 16, to controls conveyance of the sheet P. The main controller 11 and the conveying controller 16 may be configured such that the above-described CPU executes the program, to operate as the main controller 11 and the conveying controller 16. That is, the main controller 11 and the conveying controller 16 are not provided in the image forming apparatus 1 as separate hardwares, but the main controller 11 and the conveying controller 16 may be provided in the image forming apparatus 1 in the form of one hardware.

The operation I/F 12 is connected to an operation panel not shown. The operation I/F 12 outputs an operation signal in accordance with an operation input to the operation panel, to the main controller 11.

The communication I/F 13 is connected to a network not shown, an electronic device, or the like. The communication I/F 13 can transmit/receive data with another electronic device directly, or via the network. The communication I/F includes a LAN connector, a USB port, a wireless LAN module, and so on.

The image forming device 14 forms an image on the sheet P. For example, the image forming device 14 uniformly charges a photoreceptor drum. The image forming device 14 exposes the charged photoreceptor drum, to form an electrostatic latent image in accordance with image data for printing (print data) on the photoreceptor drum. The image forming device 14 makes toner to be attached to the electrostatic latent image formed on the photoreceptor drum, to form a toner image on the photoreceptor drum. The image forming device 14 transfers the toner image from the photoreceptor drum to the sheet P, to form an image on the sheet P.

The image forming device 14 has drums 31, exposure devices 32, developers 33, a transfer belt 34, a pair of transfer rollers 35, and a pair of the fixing rollers 36, as shown in FIG. 2, for example.

The drum 31 is a photoreceptor drum formed in a cylindrical shape. The drum 31 is provided so as to make contact with the transfer belt 34.

The exposure device 32 exposes the drum 31 charged by a charger not shown, to form an electrostatic latent image on the drum 31. The exposure device 32 has a light source for exposure such as a light emitting device, and irradiates the surface of the drum 31 with light in accordance with the print data, to form an electrostatic latent image on the surface of the drum 31.

The developer 33 makes toner (developing agent) to be attached to the electrostatic latent image formed on the drum 31, to develop the electrostatic latent image. By this means, the developer 33 forms a toner image (an image formed of toner) on the surface of the drum 31.

In addition, the drums 31, the exposure devices 32, and the developers 33 are provided for respective different colors, such as cyan, magenta, yellow and black, for example. In this case, a plurality of the developers 33 hold toners of the respective different colors.

The transfer belt 34 is a member for receiving the toner image formed on the surface of the drum 31 and transferring the toner image to the sheet P. The transfer belt 34 is supported by a support roller, and is moved by the rotation of the support roller. The transfer belt 34 receives the toner image formed on the drum 31 at the position contacting with the drum 31, and carries the received toner image to the pair of transfer rollers 35.

The pair of transfer rollers 35 are arranged to sandwich the transfer belt 34 and the sheet P therebetween. The pair of transfer rollers 35 transfers the toner image on the transfer belt 34 to the sheet P.

The pair of fixing rollers 36 are arranged to sandwich the sheet P therebetween. The pair of fixing rollers 36 are heated by a heater not shown. The pair of fixing rollers 36 pressurize the sandwiched sheet P in the heated state, to fix the toner image formed on the sheet P. That is, the pair of fixing rollers 36 fixes the toner image, to form an image on the sheet P.

The transfer rollers 35 and the fixing rollers 36 are rotated at speeds in accordance with the control of the main controller 11, at the time of forming an image on the sheet P. By this means, the transfer rollers 35 and the fixing rollers 36 form the image on the sheet P, while conveying the sheet P at a prescribed speed.

The conveying device 15 conveys the sheet P. The conveying device 15 has a plurality of guides, a plurality of conveying rollers, conveying paths, and sensors. The conveying path is a path on which the sheet P is to be conveyed. The conveying path is formed by a plurality of the guides and a plurality of the rollers. The sensor detects a conveyance position of the sheet P in the conveying path. The conveying roller is rotated by a motor which operates based on the control of the conveying controller 16, to convey the sheet P. The conveying controller 16 controls the motor of the conveying roller upon receiving an instruction of the main controller 11. In addition, a guide of a part of the plurality of guides is rotated by a motor which operates based on the control of the conveying controller 16, to switch a conveying path for conveying the sheet P.

The conveying device 15 has a sheet feeding roller 41, a sheet feeding conveying path 42, a first sheet discharge conveying path 43, a second sheet discharge conveying path 44, a reverse conveying path 45, a first discharge port 46, and a second discharge port 47, as shown in FIG. 2, for example.

In addition, the conveying device 15 has a first conveying roller 61, a second conveying roller 62, a third conveying roller 63, a fourth conveying roller 64, a first discharge roller 65, a second discharge roller 66, a first sensor 67, a second sensor 68, and a third sensor 69. The first conveying roller 61, the second conveying roller 62, the third conveying roller 63, the fourth conveying roller 64, the first discharge roller 65, and the second discharge roller 66 are respectively rotated by speeds in accordance with the control of the conveying controller 16. By this means, the first conveying roller 61, the second conveying roller 62, the third conveying roller 63, the fourth conveying roller 64, the first discharge roller 65, and the second discharge roller 66 convey the sheet P at speeds in accordance with the control of the conveying controller 16. Each of the first sensor 67, the second sensor 68, and the third sensor 69 detects passing of the sheet P, and outputs the detection result to the main controller 11.

The sheet feeding roller 41 feeds the sheet P housed in the sheet feeding cassette 22 to the sheet feeding conveying path 42.

The sheet feeding conveying path 42 conveys the sheet P which has been fed from the sheet feeding cassette 22 by the sheet feeding roller 41 to the image forming device 14. The sheet feeding conveying path 42 is formed by the first conveying roller 61, and a guide and so on not shown. The first conveying roller 61 is rotated at a speed in accordance with the control of the conveying controller 16, to feed the sheet P to the image forming device 14 at a speed in accordance with the control of the conveying controller 16.

The first sheet discharge conveying path 43 conveys the sheet P formed with the image by the image forming device 14 to the first discharge port 46. The first discharge conveying path 43 is formed by the second conveying roller 62, the third conveying roller 63, and a guide and so on not shown. The second conveying roller 62 and the third conveying roller 63 are rotated at speeds in accordance with the control of the conveying controller 16, to convey the sheet P at a speed in accordance with the control of the conveying controller 16.

The first discharge port 46 is provided at a terminal end of the first sheet discharge conveying path 43, for example. The first discharge port 46 is provided in the vicinity of the first sheet discharge tray 23 provided on the upper surface of the chassis 21. The first discharge port 46 discharges the sheet P which has been conveyed by the first sheet discharge conveying path 43 from the chassis 21. At the first discharge port 46, the first discharge roller 65, and a guide and so on not shown are arranged. The first discharge roller 65 is rotated at a speed in accordance with the control of the conveying controller 16, to discharge the sheet P from the first discharge port 46 at the speed in accordance with the control of the conveying controller 16. The sheet P which has been discharged from the first discharge port 46 is loaded on the first sheet discharge tray 23.

The second sheet discharge conveying path 44 conveys the sheet P formed with the image by the image forming device 14 to the second discharge port 47. In the second sheet discharge conveying path 44, the second conveying roller 62, the fourth conveying roller 64, and a guide and so on not shown are arranged. The second conveying roller 62 and the fourth conveying roller 64 are rotated at speeds in accordance with the control of the conveying controller 16, to convey the sheet P at a speed in accordance with the control of the conveying controller 16.

The second discharge port 47 is provided at a terminal end of the second sheet discharge conveying path 44, for example. The second discharge port 47 is provided in the vicinity of the second sheet discharge tray 24 provided at the side surface of the chassis 21. At the second discharge port 47, the second discharge roller 66, and a guide and so on not shown are arranged. The second discharge roller 66 is rotated at a speed in accordance with the control of the conveying controller 16, to discharge the sheet P from the second discharge port 47 at a speed in accordance with the control of the conveying controller 16. The sheet P which has been discharged from the second discharge port 47 is loaded on the second sheet discharge tray 24.

The reverse conveying path 45 feeds the sheet P in the state in which the front/back and the front/rear of the sheet P that has passed through the image forming device 14 are reversed, to the image forming device 14 again.

The first sensor 67 detects passing of the sheet P in which an image has been formed by the image forming device 14 and which has been discharged from the fixing roller 36, and outputs the detection result to the main controller 11. For example, the first sensor 67 is provided between the fixing roller 36 and the second conveying roller 62. The first sensor 67 detects passing of the rear end of the sheet P, to detect that the sheet P has passed through the fixing roller 36. In addition, the first sensor 67 is provided between the fixing roller 36 and the second conveying roller 62, and may be configured to detect passing of the front end of the sheet P.

The second sensor 68 detects passing of the sheet P which is conveyed by the first sheet discharge conveying path 43, and outputs the detection result to the main controller 11. For example, the second sensor 68 is provided between the third conveying roller 63 and the first discharge roller 65, and detects passing of the rear end of the sheet P. In addition, the second sensor 68 is provided between the third conveying roller 63 and the first discharge roller 65, and may be configured to detect passing of the front end of the sheet P.

The third sensor 69 detects passing of the sheet P which is conveyed by the second sheet discharge conveying path 44, and outputs the detection result to the main controller 11. For example, the third sensor 69 is provided between the fourth conveying roller 64 and the second discharge roller 66, and detects passing of the rear end of the sheet P. In addition, the third sensor 69 is provided between the fourth conveying roller 64 and the second discharge roller 66, and may be configured to detect passing of the front end of the sheet P.

The conveying controller 16 controls conveyance of the sheet P by the conveying device 15. For example, the conveying controller 16 drives the motors of the conveying device 15, to rotate the conveying rollers. For example, the conveying controller 16 controls driving speeds of the motors of the conveying device 15, in accordance with instruction from the main controller 11. The conveying controller 16 controls the driving speeds of the motors, and thereby controls a speed at the time of conveying the sheet P by the first sheet discharge conveying path 43, a speed at the time of conveying the sheet P by the second sheet discharge conveying path 44, a speed at the time of discharging the sheet P from the first discharge port 46, and a speed at the time of discharging the sheet P from the second discharge port 47.

For example, the conveying controller 16 controls rotation speeds of the second conveying roller 62 and the third conveying roller 63. The conveying controller 16 controls a speed at the time of conveying the sheet P by the first sheet discharging conveying path 43, by this control of the rotation speeds. In addition, the conveying controller 16 controls rotation speeds of the second conveying roller 62 and the fourth conveying roller 64. The conveying controller 16 controls a speed at the time of conveying the sheet P by the second sheet discharging conveying path 44, by this control of the rotation speeds. In addition, the conveying controller 16 controls a rotation speed of the first discharge roller 65. The conveying controller 16 controls a speed at the time of discharging the sheet P from the first discharge port 46, by this control of the rotation speed. In addition, the conveying controller 16 controls a rotation speed of the second discharge roller 66. The conveying controller 16 controls a speed at the time of discharging the sheet P from the second discharge port 47, by this control of the rotation speed.

In addition, for example, the conveying controller 16 drives the motor of the conveying device 15, to make the guide for switching the conveying path for conveying the sheet P to be rotated. For example, the conveying controller 16 makes the guide for switching the conveying path to be rotated, to switch a conveying destination of the sheet P formed with an image by the image forming device 14. Specifically, the conveying controller 16 makes the guides for switching the conveying path to be rotated. The conveying controller 16 makes the guides to be rotated, to switch the conveying destination of the sheet P to any of the first sheet discharge conveying path 43, the second sheet discharge conveying path 44, and the reverse conveying path 45.

The thickness sensor 17 detects a thickness of the sheet P. The thickness sensor 17 outputs the detected thickness of the sheet P to the main controller 11. The thickness sensor 17 irradiates the sheet P to be fed by the sheet feeding roller with light, to detect a thickness of the sheet P in accordance with a strength of the light which has passed through the sheet P, for example. In addition, the thickness sensor 17 may be configured to detect a thickness of the sheet P by mechanically interposing the sheet P. In addition, the thickness sensor 17 may be one using a laser displacement meter. In addition, the thickness sensor 17 may be one using a ultrasonic thickness meter. The thickness sensor 17 is provided at the downstream side in the conveying direction of the sheet P from the pair of transfer rollers 35.

The loading sensor 18 detects a loading amount of the sheets P loaded on the first sheet discharge tray 23. The loading sensor 18 outputs the detected loading amount of the sheets P to the main controller 11.

Figure 3:
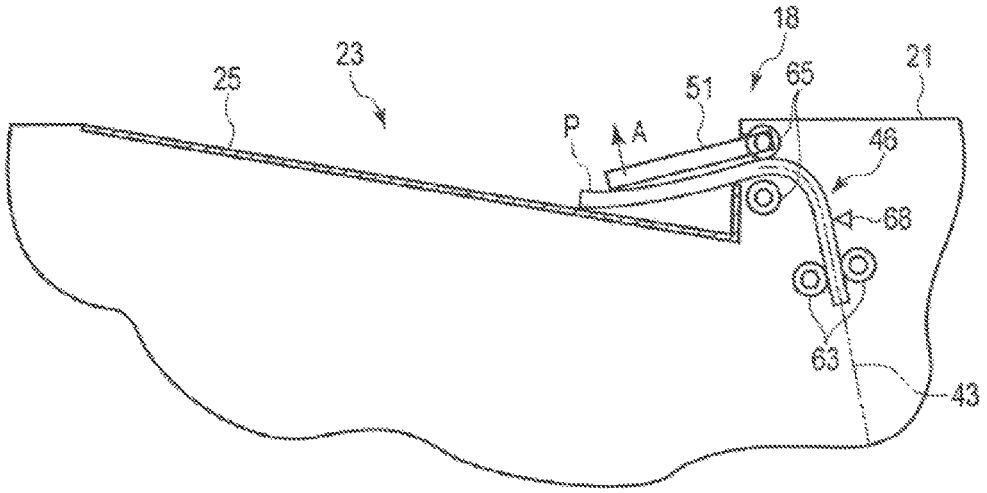
FIG. 3 is a sectional view showing a part of the image forming apparatus according to the embodiment.

FIG. 3 is a sectional view showing a configuration in the vicinity of the first sheet discharge tray 23. The first sheet discharge tray 23 has a first surface 25 which supports the sheet P which has been discharged from the first discharge port 46.

The loading sensor 18 detects a loading amount of the sheets P loaded on the first sheet discharge tray 23, in accordance with a displacement of a pressing member 51 in the direction of an arrow A shown in FIG. 3, for example. The loading sensor 18 includes the pressing member 51 which is attached rotatably around one of the pair of first discharge rollers 65 arranged at the first discharge port 46 as a fulcrum point, for example. The pressing member 51 presses the sheet P which has been discharged from the first discharge port 46 by its own weight, toward the first surface 25 of the first sheet discharge tray 23. The loading sensor 18 detects change of a rotation angle of the pressing member 51 rotating around the fulcrum point, for example. The loading sensor 18 detects a loading amount of the sheets P loaded on the first sheet discharge tray 23, in accordance with the change of the rotation angle of the pressing member 51. According to the configuration like this, each time the sheet P which has been discharged from the first discharge port 46 is loaded on the first surface 25 of the first sheet discharge tray 23, the pressing member 51 of the loading sensor 18 is pressed up in the direction of the arrow A by the sheet P. By this means, the loading sensor 18 can detects the loading amount of the sheets P.

When the first sheet discharge tray 23, the first discharge port 46, and the loading sensor 18 are configured as described above, a force toward the first surface 25 is applied to the sheet P in the middle of being discharged from the first discharge port 46. By this means, the sheet P discharged from the first discharge port 46 is dropped on the first surface 25 of the first sheet discharge tray 23, irrespective of that the flexibility of the sheet P is high or low, and a speed of the sheet P at the time of being discharged from the first discharge port 46.

Figure 4:
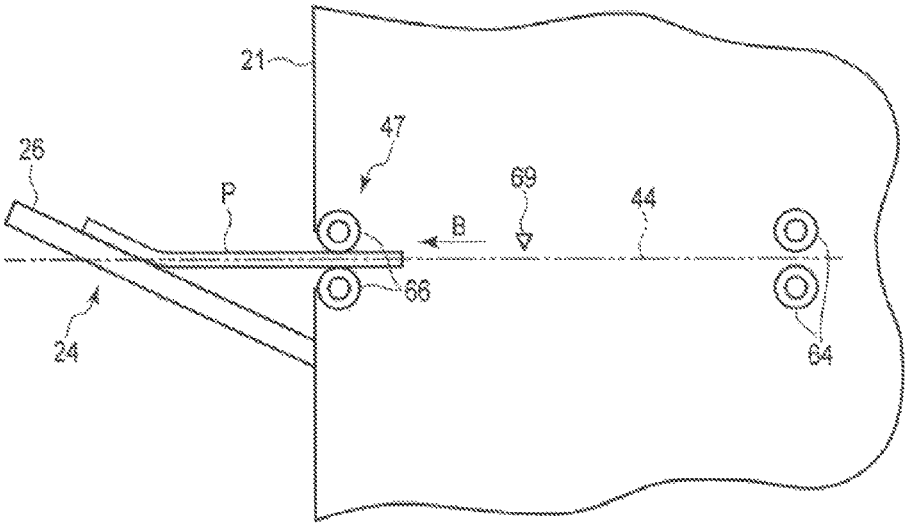
FIG. 4 is a sectional view showing a part of the image forming apparatus according to the embodiment.

FIG. 4 is a sectional view showing a configuration in the vicinity of the second sheet discharge tray 24. The second sheet discharge tray 24 has a second surface 26 which supports the sheet P which has been discharged from the second discharge port 47.

The second surface 26 is provided so as to form an angle to a discharge direction (a direction along an arrow B in FIG. 4) of the sheet P from the second discharge port 47. When the second sheet discharge tray 24 is configured like this, the sheet P which has been discharged from the second discharge port 47 in the direction of the arrow B comes in contact with the second surface 26 or another sheet P loaded on the second surface 26. By this means, a friction force in the direction opposite to the arrow B is generated to the sheet P in the middle of being discharged from the second discharge port 47 in the direction of the arrow B.

When the second sheet discharge tray 24, and the second discharge port 47 are configured as described above, a force (a friction force) acting in the direction opposite to the discharge direction is generated, to the sheet P in the middle of being discharged from the second discharge port 47. By this means, there is a possibility that a matter is generated in which the rear end side of the sheet P in the discharge direction has not been dropped on the second surface 26 of the second sheet discharge tray 24, but has been caught by a structure in the vicinity of the second discharge port 47. The matter like this is easily caused by that a speed of the sheet P when the sheet P is discharged from the second discharge port 47 is insufficient, the flexibility of the sheet P is low, and so on.

Accordingly, the image forming apparatus 1 controls a speed of the sheet P when the sheet P is discharged from the second discharge port 47, in accordance with the property of the sheet P to be discharged from the second discharge port 47.

The main controller 11 executes a program for discriminating a kind of the sheet P stored in the memory, and acquires information indicating the kind of the sheet P, based on the detection result of the above-described thickness sensor 17. That is, the main controller 11 and the thickness sensor 17 function as a kind acquisition section. The information indicating the kind of the sheet P is information for discriminating the sheets P with different flexibilities, such as "a plain paper", "a special paper", "a cardboard", "an OHP film", for example.

The main controller 11 acquires information indicating the kind of the sheet P, based on the thickness of the sheet P detected by the thickness sensor 17, for example. Specifically, the main controller 11 has a memory to store a table in which the information indicating the kind of the sheet P and the information indicating the thickness of the sheet P are associated. The main controller 11 refers to the above-described table, based on the thickness of the sheet P detected by the thickness sensor 17, to acquire the information indicating the kind of the sheet P.

The main controller 11 outputs a control signal to the conveying controller 16 in accordance with the kind of the sheet P, to control a speed (a conveying speed) of the sheet P when the sheet P is conveyed by the conveying device 15. By this means, the main controller 11 controls a speed of the sheet P when the sheet P is discharged from the first discharge port 46, or the second discharge port 47.

Figure 5:
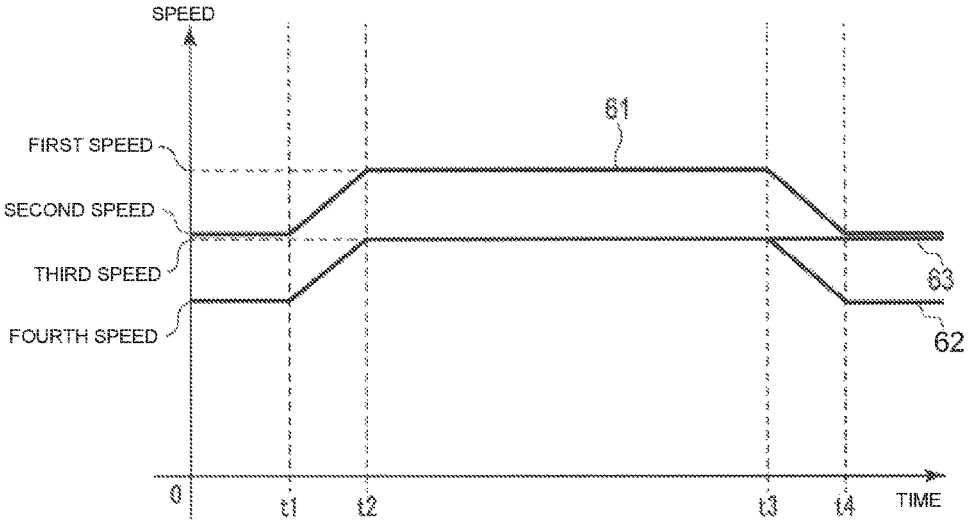
FIG. 5 is a diagram for describing an example of an operation of the image forming apparatus according to the embodiment.

FIG. 5 is a diagram for describing speeds at the time of conveying and discharging the sheet P. In FIG. 5, the horizontal axis shows a time, and the vertical axis shows a conveying speed. In addition, in the present embodiment, an example will be described in which a sheet of any kind of a first kind (for example, a plain paper) and a second kind (for example, a cardboard, an OHP film and so on) having a lower flexibility than the first kind is processed. But a sheet of the first kind and a sheet of the second kind may be any sheets if the sheets have different flexibilities. In addition, here, an end portion of the front side, and an end portion of the rear side in the conveying direction of the sheet P are respectively referred to as a front end, and a rear end. In addition, in the present embodiment, it is assumed that the image forming apparatus 1 conveys and discharges the sheet P at any speed of a first speed, a second speed slower than the first speed, a third speed slower than the second speed, and a fourth speed slower than the third speed.

(Regarding the First Kind of Sheet P)

To begin with, the first kind of sheet P will be described. A graph 61 of FIG. 5 shows a conveying speed of the sheet P when the first kind of sheet P is discharged from the first discharge port 46 or the second discharge port 47.

To begin with, the main controller 11 makes the first kind of sheet P pass through the fixing roller 36 of the image forming device 14, while conveying the sheet P at the second speed. The main controller 11 calculates a timing t1, based on the detection result of the first sensor 67 and the second speed. The timing t1 is an optional timing after the rear end of the sheet P has passed through the fixing roller 36, for example. The main controller 11 controls the conveying controller 16 so that acceleration of the conveying speed of the first kind of sheet P is started at the timing t1. In addition, when having started accelerating the conveying speed of the sheet P at the timing t1, the main controller 11 calculates a timing t2 that is a timing when the acceleration is completed. For example, the main controller 11 controls the conveying controller 16 so that the conveying speed of the first kind of sheet P is gradually accelerated from the second speed to the first speed that is faster than the second speed, from the timing t1 to the timing t2 that is a prescribed time after the timing t1.

The main controller 11 firstly calculates a timing t3 and a timing t4, based on the detection result of the second sensor 68, the first speed and the second speed. The timing t4 is an optional timing before the rear end of the sheet P reaches the first discharge roller 65 of the first discharge port 46, or the second discharge roller 66 of the second discharge port 47, for example. The timing t3 is a timing for starting deceleration so as to complete the deceleration of the conveying speed of the sheet P by the timing t4. Next, the main controller 11 controls the conveying controller 16 so that the conveying speed of the first kind of sheet is kept to be the first speed between the timing t2 and the timing t3, for example.

Next, the main controller 11 controls the conveying controller 16 so that deceleration of the conveying speed of the first kind of sheet P is started at the timing t3. The main controller 11 controls the conveying controller 16 so that the conveying speed of the first kind of sheet P is gradually decelerated to a speed that is slower than the first speed (for example the second speed), from the timing t3 to the timing t4 that is a prescribed time after the timing t3. The main controller 11 controls the conveying controller 16 so that the first kind of sheet P is discharged at the timing t4 from the first discharge port 46 or the second discharge port 47 at the second speed.

As described above, for example, the main controller 11 controls the rotation speeds of the second conveying roller 62 and the third conveying roller 63 to a speed in accordance with the first speed, at a timing when the first kind of sheet P has passed through the fixing roller 36. Further, the main controller 11 controls the rotation speed of the first discharge roller 65 to a speed in accordance with the second speed, at a timing when the first kind of sheet P is discharged from the first discharge port 46.

(Regarding the Second Kind of Sheet P)

Next, the second kind of sheet P will be described. A graph 62 of FIG. 5 shows a conveying speed of the sheet P when the second kind of sheet P is discharged from the first discharge port 46.

The main controller 11 makes the second kind of sheet P pass through the fixing roller 36 of the image forming device 14, while conveying the sheet P at the fourth speed. The main controller 11 calculates the timing t1 and the timing t2, based on the detection result of the first sensor 67 and the fourth speed. The main controller 11 controls the conveying controller 16 so that acceleration of the conveying speed of the second kind of sheet P is started at the timing t1. For example, the main controller 11 controls the conveying controller 16 so that the conveying speed of the second kind of sheet P is gradually accelerated from the fourth speed to the third speed that is faster than the fourth speed, from the timing t1 to the timing t2 that is a prescribed time after the timing t1. Next, the main controller 11 controls the conveying controller 16 so that the conveying speed of the second kind of sheet is keep to be the third speed between the timing t2 and the timing t3, for example.

Next, the main controller 11 calculates the timing t3 and the timing t4, based on the detection result of the third sensor 69, the third speed and the fourth speed. The main controller 11 controls the conveying controller 16 so that deceleration of the conveying speed of the second kind of sheet P is started at the timing t3. The main controller 11 controls the conveying controller 16 so that the conveying speed of the second kind of sheet P is gradually decelerated to a speed that is slower than the third speed (for example the fourth speed), from the timing t3 to the timing t4 that is a prescribed time after the timing t3. The main controller 11 controls the conveying controller 16 so that the second kind of sheet P is discharged at the timing t4 from the first discharge port 46 at the fourth speed.

As described above, for example, the main controller 11 controls the rotation speeds of the second conveying roller 62 and the third conveying roller 63 to a speed in accordance with the third speed, at a timing when the second kind of sheet P has passed through the fixing roller 36. Further, the main controller 11 controls the rotation speed of the first discharge roller 65 to a speed in accordance with the fourth speed, at a timing when the second kind of sheet P is discharged from the first discharge port 46.

A graph 63 of FIG. 5 shows a conveying speed of the sheet P when the second kind of sheet P is discharged from the second discharge port 47.

The main controller 11 makes the second kind of sheet P pass through the fixing roller 36 of the image forming device 14, while conveying the sheet P at the fourth speed that is slower than the first speed. The main controller 11 controls the conveying controller 16 so that acceleration of the conveying speed of the second kind of sheet P is started at the timing t1. For example, the main controller 11 controls the conveying controller 16 so that the conveying speed of the second kind of sheet P is gradually accelerated from the fourth speed to the third speed that is faster than the fourth speed, from the timing t1 to the timing t2 that is a prescribed time after the timing t1. Next, the main controller 11 controls the conveying controller 16 so that the conveying speed of the second kind of sheet is kept to be the third speed between the timing t2 and the timing t3, for example.

The main controller 11 controls the conveying controller 16 so that the conveying speed of the second kind of sheet P is not decelerated, but is kept to be the equal speed (so that the third speed is kept) further at the timing t3 and later. By this means, the main controller 11 controls the conveying controller 16 so that the second kind of sheet P is discharged at the timing t4 from the second discharge port 47 at the third speed.

As described above, for example, the main controller 11 controls the rotation speeds of the second conveying roller 62 and the fourth conveying roller 64 to a speed in accordance with the third speed, at a timing when the second kind of sheet P has passed through the fixing roller 36. Further, the main controller 11 controls the rotation speed of the second discharge roller 66 to a speed in accordance with the third speed, at a timing when the second kind of sheet P is discharged from the second discharge port 47.

Figure 6:
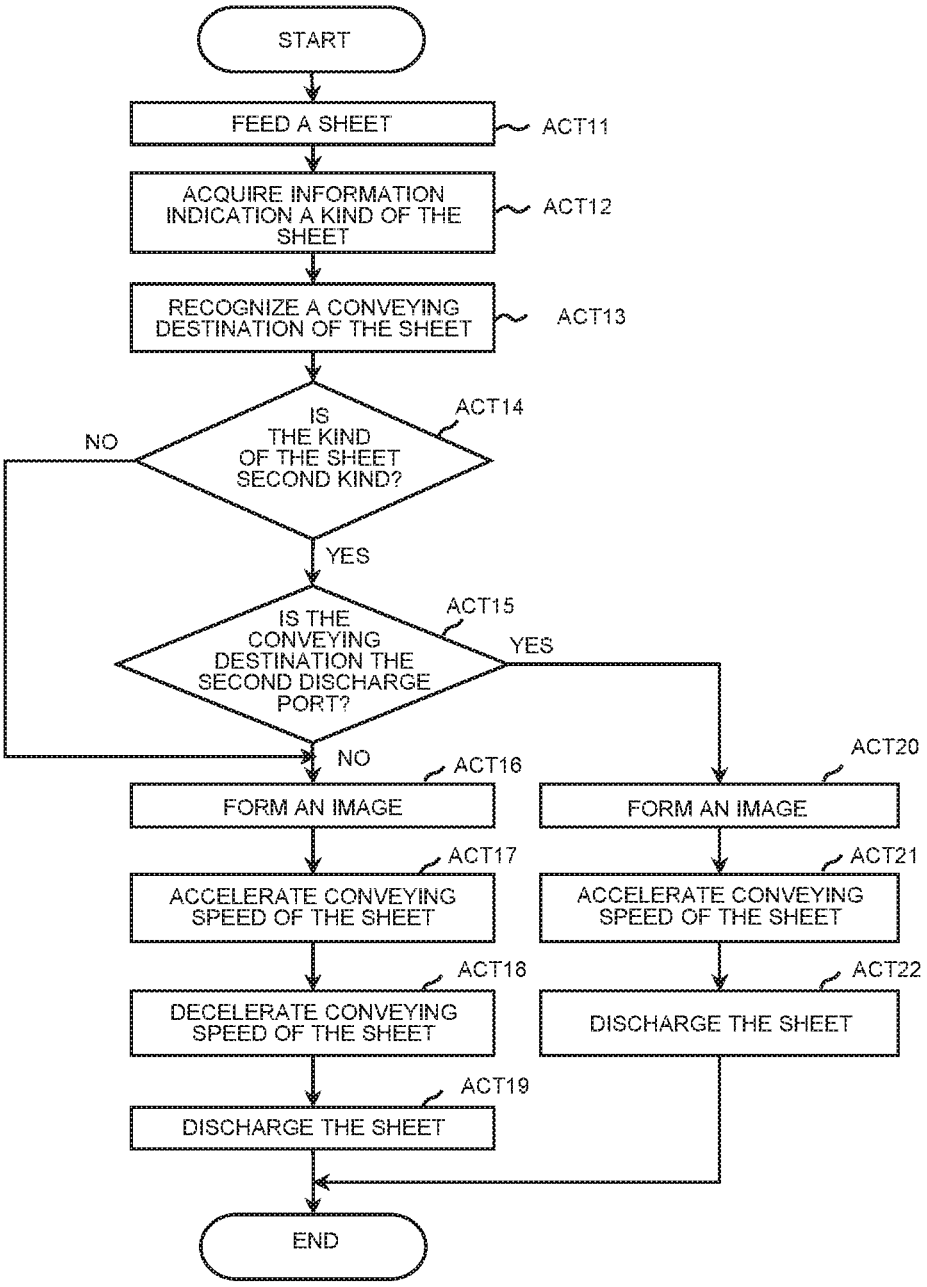
FIG. 6 is a flow chart showing an operation of the image forming apparatus according to the embodiment.

FIG. 6 is a flow chart for describing an operation of the image forming apparatus 1. When having received a print instruction, the image forming apparatus 1 executes a processing shown in FIG. 6.

The image forming apparatus 1 feeds a sheet P from the sheet feeding cassette 22 by the conveying device 15 (ACT11).

The image forming apparatus 1 acquires information indicating a kind of the fed sheet P (ACT12). For example, the main controller 11 of the image forming apparatus 1 acquires the information indicating the kind of the sheet P, based on a sheet setting which has been previously generated in accordance with an input of a user. In addition, for example, the main controller 11 of the image forming apparatus 1 may acquire the information indicating the kind of the sheet P, in accordance with the detection result of the thickness sensor 17.

The main controller 11 of the image forming apparatus 1 recognizes a conveying destination of the sheet P (ACT13). For example, the main controller 11 recognizes a conveying destination (a discharge destination) of the sheet P, in accordance with a print instruction, or the information indicating the kind of the sheet P which has been acquired by the processing of the ACT12.

The main controller 11 judges whether or not the kind of the sheet P is the second kind (ACT14). That is, the main controller 11 judges whether or not the sheet P of the processing object is a cardboard having a low flexibility.

When having judged that the kind of the sheet P is the second kind, the main controller 11 judges whether or not the conveying destination (discharge destination) is the second discharge port 47, based on the recognition result in the above-described ACT13 (ACT15).

When having judged that the kind of the sheet P is not the second kind (NO in ACT14), or having judged that the conveying destination is not the second discharge port 47 (NO in ACT15), the main controller 11 conveys the sheet P to the image forming device 14 by the conveying device 15. Further, the main controller 11 forms an image on the sheet P by the image forming device 14 (ACT16).

The main controller 11 controls the conveying device 15 and the conveying controller 16 so that the conveying speed of the sheet P formed with the image by the image forming device is accelerated (ACT17). That is, the main controller 11 controls the conveying device 15 and the conveying controller 16 so that the conveying speed of the sheet P is accelerated at a timing (refer to the timing t1 of the graphs 61, 62 of FIG. 5) when the sheet P has passed through the fixing roller 36 of the image forming device 14.

The main controller 11 controls the conveying device 15 and the conveying controller 16 so that the sheet P can be discharged in a decelerated state, and the conveying speed of the sheet P is decelerated (ACT18). The main controller 11 controls the conveying device 15 and the conveying controller 16 so that the deceleration of the sheet P has been completed at least before the rear end of the sheet P reaches the discharge roller of the discharge port (refer to the timing t4 of the graphs 61, 62 of FIG. 5).

The image forming apparatus 1 discharges the first kind of sheet P from the first discharge port 46 or the second discharge port 47 in the decelerated state (ACT19), and finishes the processing. Or, the image forming apparatus 1 discharges the second kind of sheet P from the first discharge port 46 in the decelerated state (ACT19), and finishes the processing.

In addition, when having judged that the conveying destination (discharge destination) is the second discharge port 47 (YES in ACT15), the main controller 11 conveys the sheet P to the image forming device 14 by the conveying device 15. Further, the main controller 11 forms an image on the sheet P by the image forming device 14 (ACT20).

The main controller 11 controls the conveying device 15 and the conveying controller 16 so that the conveying speed of the sheet P formed with the image by the image forming device 14 is accelerated (refer to the timing t1 of the graph 63 of FIG. 5) (ACT21).

Further, the main controller 11 discharges the second kind of the sheet P from the second discharge port 47 in the state in which the speed after acceleration (the third speed) is not decelerated and is kept (refer to the timing t3 and later of the graph 63 of FIG. 5) (ACT22), and finishes the processing.

As described above, the main controller 11 controls the conveying controller 16 so that after the first kind of sheet P has passed through the fixing roller 36, the conveying speed of the sheet P is accelerated, and the sheet P is decelerated during a time period until the sheet P is discharged from the first discharge port 46 or the second discharge port 47. In this manner, the image forming apparatus 1 makes the conveying speed of the sheet P to be accelerated, between when the sheet P has passed through the fixing roller 36 and when it is discharged, and thereby can discharge the sheet P at a faster speed. In addition, the image forming apparatus 1 discharges the first kind of sheet P in the state in which the conveying speed has been decelerated from the first speed after acceleration to the second speed, and thereby can prevent the discharged first kind of sheet P from being blown off by the power at the time of discharge.

In addition, as described above, the main controller 11 controls the conveying controller 16 so that after the second kind of sheet P has passed through the fixing roller 36, the conveying speed of the sheet P is accelerated, and the second kind of sheet P is decelerated during a time period until the second kind of sheet P is discharged from the first discharge port 46. In this manner, the image forming apparatus 1 makes the conveying speed of the second kind of sheet P to be accelerated, between when the second kind of sheet P has passed through the fixing roller 36 and when it is discharged, and thereby can discharge the second kind of sheet P at a faster speed.

In addition, as described above, the main controller 11 controls the conveying controller 16 so that after the second kind of sheet P has passed through the fixing roller 36, the conveying speed of the second kind of sheet P is accelerated. Further, the main controller 11 controls the conveying controller 16 so that after the second kind of sheet P has been accelerated, the second kind of sheet P is discharged from the second discharge port 47 without being decelerated (at the equal speed). In this manner, the image forming apparatus 1 discharges the second kind of sheet P from the second discharge port 47 at a faster speed compared with the first discharge port 46. By this means, when discharging the sheet P, such as a cardboard (the second kind of sheet), having a lower flexibility than a plain paper (the first kind of sheet) from the second discharge port 47, the image forming apparatus 1 can suppress a possibility that the sheet P of a cardboard is caught by the second discharge port 47 and a structure in the vicinity of the second discharge port 47.

In addition, the main controller 11 may perform the above-described control assuming that the above-described second speed and the third speed are the equal speed. According to this configuration, because the second speed and the third speed can be used commonly, the stage for varying the conveying speed can be reduced.

In addition, a difference of a prescribed speed may exist between the above-described second speed and the third speed. When the difference of the prescribed speed exists between the above-described second speed and the third speed, setting of the conveying speed of the sheet P can be made more flexibly.

In addition, the above-described third speed may be a speed faster than the second speed. According to such a configuration that the third speed is faster than the second speed, it is possible to further decrease a possibility that the second kind of sheet P is caught by a structure in the vicinity of the second discharge port 47.

In addition, in the above-described embodiment, it has been described that the main controller 11 has such a configuration that after the conveying speed of the second kind of sheet P has been accelerated, the second kind of sheet P is discharged from the second discharge port 47 without being decelerated (at the equal speed), but the embodiment is not limited to this configuration. The main controller 11 may control the conveying controller 16 so that after the conveying speed of the second kind of sheet P has been accelerated from the fourth speed to the third speed, it is decelerated to a speed that is slower than the third speed and faster than the fourth speed, and the sheet P is discharged from the second discharge port 47.

In addition, in the above-described embodiment, it has been described that the main controller 11 has such a configuration that the conveying speed of the sheet P is controlled in accordance with the kind of the sheet P, but the embodiment is not limited to this configuration. The main controller 11 may control the conveying speed of the sheet P, in accordance with the discharge number of the sheets P. For example, the main controller 11 counts the discharge number of the sheets P in a print processing of one set (a print processing based on one print instruction). For example, when the discharge number of the sheets P is less than a predetermined threshold value, after having accelerated the conveying speed of the second kind of sheet P, the main controller 11 discharges the second kind of sheet P from the second discharge port 47 without decelerating the conveying speed (at the equal speed). And when the discharge number of the sheets P is not less than the predetermined threshold value, the main controller 11 may control the conveying controller 16 so that after the conveying speed of the second kind of the sheet P has been accelerated, the conveying speed is decelerated, and the sheet P is discharged from the second discharge port 47. In addition, for example, when the discharge number of the sheets P is less than the predetermined threshold value, after having accelerated the conveying speed of the second kind of sheet P, the main controller 11 decelerates the conveying speed and discharges the sheet P from the second discharge port 47. And when the discharge number of the sheets P is not less than the predetermined threshold value, the main controller 11 may control the conveying controller 16 so that after the conveying speed of the second kind of sheet P has been accelerated, the sheet P is discharged without being decelerated (at the equal speed) from the second discharge port 47.

In addition, the image forming apparatus 1 may be a configuration to which a post-stage processing apparatus (for example, a sealing processing apparatus) is connectable. Here, the sheet P discharged from the second discharge port 47 is to be fed to the post-stage processing apparatus. The sealing processing apparatus is an apparatus which performs a processing such as sealing by binding and sealing a plurality of the sheets P discharged from the image forming apparatus 1. The sealing processing apparatus has a feeding port to which the sheet P discharged from the second discharge port 47 is to be fed. In addition, the main controller 11 of the image forming apparatus 1 judges whether or not the sealing processing apparatus is connected to the second discharge port 47, in accordance with a detection result of a sensor of some kind. When having judged that the sealing processing apparatus is connected to the second discharge port 47, the main controller 11 may control the conveying controller 16 so that after the conveying speed of the first kind of sheet P or the second kind of sheet P has been accelerated, the sheet P is discharged from the second discharge port 47 without being decelerated (at the equal speed). That is, the main controller 11 judges whether or not the post-stage processing apparatus to which the sheet P discharged from the second discharge port 47 is to be fed is connected to the second discharge port 47. When having judged that the post-processing apparatus is connected to the second discharge port 47, the main controller controls the conveying controller 16 so that after the conveying speed of the first kind of sheet P has been accelerated to the first speed that is faster than the second speed, the sheet P is discharged from the second discharge port 47 without being decelerated to the second speed (at the equal speed). In addition, when having judged that the post-processing apparatus is connected to the second discharge port 47, the main controller 11 controls the conveying controller 16 so that after the conveying speed of the second kind of sheet P has been accelerated to the third speed that is faster than the fourth speed, the sheet P is discharged from the second discharge port 47 without being decelerated to the fourth speed (at the equal speed). According to this configuration, the image forming apparatus 1 can feed the sheet P to the post-stage processing apparatus at a faster speed.

In addition, the main controller 11 may solely function as a kind acquisition section. For example, the main controller 11 may acquire the information indicating the kind of the sheet P, based on a previously generated sheet setting. This sheet setting is information indicating the kind of the sheet P housed in the sheet feeding cassette 22 of the image forming apparatus 1, for example. When the image forming apparatus 1 has a plurality of the sheet feeding cassettes 22, the sheet setting may be configured to indicate the kind of the sheet P for each of the sheet feeding cassettes 22. The main controller 11 generates a sheet setting in accordance with an operation input by the operation I/F 12, or a signal of a print instruction and so on acquired via the communication I/F 13, and stores it in the memory. In addition, the main controller 11 may be configured to acquire information indicating the kind of the sheet P by another means of some kind.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a chassis;

an image forming device which is housed in the chassis and which forms an image on a recording medium;

a plurality of discharge ports of the recording medium provided at a downstream side of the image forming device, the discharge ports including a first discharge port provided on an upper surface of the chassis and a second discharge port provided at a side surface of the chassis;

a conveying device which conveys the recording medium to the first or the second discharge port via the image forming device; and a controller configured to acquire information indicating a type of recording medium, when having judged that the type of recording medium is of a first type based on the acquired information, control the conveying device so that after the recording medium has been conveyed at a first speed at the downstream side from the image forming device, the recording medium is decelerated to a second speed that is slower than the first speed and is discharged from the first or the second discharge port, and when having judged that the type of recording medium is of a second type based on the acquired information, control the conveying device so that after the recording medium has been conveyed at a third speed that is slower than the first speed at the downstream side from the image forming device, the recording medium is discharged from the first or the second discharge port at a speed equal to or slower than the third speed.

2. The image forming apparatus according to claim 1, further comprising:

a tray which supports the discharged recording medium; and a pressing member which presses the recording medium in a direction toward the tray;

wherein the pressing member is arranged at the first discharge port.

3. The image forming apparatus according to claim 2, wherein when having judged that a conveying destination of the second type of recording medium is the first discharge port, the controller controls the conveying device so that after the recording medium has been conveyed at the third speed, the conveying speed of the second type of recording medium is decelerated to a fourth speed that is slower than the third speed, and the second type of recording medium is discharged from the first discharge port at the fourth speed.

4. The image forming apparatus according to claim 3, wherein when having judged that the conveying destination of the second type of recording medium is the second discharge port, the controller controls the conveying device so that after the recording medium has been conveyed at the third speed, the second type of recording medium is discharged from the second discharge port at the third speed.

5. The image forming apparatus according to claim 4, wherein the third speed is slower than the second speed.

6. The image forming apparatus according to claim 4, wherein the third speed is equal to the second speed.

7. The image forming apparatus according to claim 4, wherein the controller judges whether or not a post-stage processing apparatus to which the recording medium discharged from the second discharge port is to be fed is connected to the second discharge port, and when having judged that the post-stage processing apparatus is connected to the second discharge port, and having judged that the type of recording medium is of the first type, the controller controls the conveying device so that the conveying speed of the first type of recording medium is accelerated to the first speed, and after the first type of recording medium has been conveyed at the first speed, the recording medium is discharged from the second discharge port without being decelerated from the first speed to the second speed.

8. The image forming apparatus according to claim 7, wherein when having judged that the post-stage processing apparatus is connected to the second discharge port, and having judged that the type of recording medium is of the second type, the controller controls the conveying device so that the conveying speed of the second type of recording medium is accelerated to the third speed, and after the second type of recording medium has been conveyed at the third speed, the recording medium is discharged from the second discharge port without being decelerated to the fourth speed.

9. An image forming apparatus, comprising:

a chassis;

an image forming device which is housed in the chassis and which forms an image on a recording medium;

a first discharge port provided on an upper surface of the chassis and at a downstream side of the image forming device;

a second discharge port provided at a side surface of the chassis and at a downstream side of the image forming device;

a conveying device which conveys the recording medium to the first discharge port or the second discharge port via the image forming device; and a controller configured to acquire information indicating a type of recording medium, judge whether a conveying destination of the recording medium is the first discharge port or the second discharge port, when having judged that the type of recording medium is of a first type based on the acquired information, control the conveying device so that after the recording medium has been conveyed at a first speed at the downstream side from the image forming device, the first type of recording medium is discharged from the first discharge port or the second discharge port at a second speed, when having judged that the type of recording medium is of a second type based on the acquired information, and having judged that the conveying destination of the recording medium is the first discharge port, control the conveying device so that the second type of recording medium is discharged from the first discharge port at a fourth speed, and when having judged that the type of recording medium is of the second type based on the acquired information, and having judged that the conveying destination of the recording medium is the second discharge port, control the conveying device so that the second type of recording medium is discharged from the second discharge port at a third speed that is faster than the fourth speed.

10. The image forming apparatus according to claim 9, further comprising:

a first sheet discharge tray including a first surface which supports the recording medium discharged from the first discharge port; and a second sheet discharge tray including a second surface which supports the recording medium discharged from the second discharge port;

wherein the second surface is formed to form an angle to a discharge direction of the recording medium from the second discharge port.

11. The image forming apparatus according to claim 9, wherein the third speed is slower than the second speed.

12. The image forming apparatus according to claim 9, wherein the third speed is equal to the second speed.

13. The image forming apparatus according to claim 9, wherein the controller judges whether or not a post-stage processing apparatus to which the recording medium discharged from the second discharge port is to be fed is connected to the second discharge port, and when having judged that the post-stage processing apparatus is connected to the second discharge port, and having judged that the type of recording medium is of the first type, the controller controls the conveying device so that the conveying speed of the first type of recording medium is accelerated to the first speed, and after the first type of recording medium has been conveyed at the first speed, the recording medium is discharged from the second discharge port without being decelerated from the first speed to the second speed.

14. The image forming apparatus according to claim 13, wherein when having judged that the post-stage processing apparatus is connected to the second discharge port, and having judged that the type of recording medium is of the second type, the controller controls the conveying device so that the conveying speed of the second type of recording medium is accelerated to the third speed, and after the second type of recording medium has been conveyed at the third speed, the recording medium is discharged from the second discharge port without being decelerated to the fourth speed.

15. An image forming method of an image forming apparatus having a chassis, an image forming device which is housed in the chassis and which forms an image on a recording medium, a first discharge port which is provided on an upper surface of the chassis and at a downstream side of the image forming device, a second discharge port which is provided at a side surface of the chassis and at downstream sides of the image forming device, and a conveying device which conveys the recording medium to the first discharge port or the second discharge port via the image forming device, comprising:

acquiring information indicating a type of recording medium, and judging whether the type of recording medium is of a first or a second type;

judging whether a conveying destination of the recording medium is the first discharge port or the second discharge port;

when having judged that the type of recording medium is of the first type, decelerating a conveying speed of the first type of recording medium irrespective of the judgement result of the conveying destination, and discharging the first type of recording medium from the first discharge port or the second discharge port;

when having judged that the type of recording medium is of the second type, and having judged that the conveying destination of the recording medium is the first discharge port, decelerating the conveying speed of the second type of recording medium, and discharging the second type of recording medium from the first discharge port; and when having judged that the type of recording medium is of the second type, and having judged that the conveying destination of the recording medium is the second discharge port, discharging the second type of recording medium from the second discharge port, without decelerating the conveying speed of the second type of recording medium.

* * * * *